United States Patent [19]

Chammas

[11] 4,250,960

[45] Feb. 17, 1981

[54] CHEMICAL CUTTING APPARATUS

[75] Inventor: Edmond D. Chammas, Houston, Tex.

[73] Assignee: Weatherford/DMC, Inc., Houston, Tex.

[21] Appl. No.: 105,162

[22] Filed: Dec. 19, 1979

[30] Foreign Application Priority Data

April 18, 1977 [GB] United Kingdom ..... 16064/77

Related U.S. Application Data

[63] Continuation-in-part of Ser. No. 953,141, Oct. 20, 1978, Pat. No. 4,180,131, which is a continuation-in-part of Ser. No. 830,511, Sep. 6, 1977, Pat. No. 4,125,161.

[51] Int. Cl.[3] ..... E21B 29/02

[52] U.S. Cl. ..... 166/55; 166/63; 166/212; 166/319

[58] Field of Search ..... 166/55, 58, 297, 63, 166/212, 55.2, 120, 169, 286, 299, 319, 320, 325, 326

[56] References Cited

U.S. PATENT DOCUMENTS

| | | | |
|---|---|---|---|
| 2,629,445 | 2/1953 | Dill | 166/55 X |
| 2,701,614 | 2/1955 | Ragan et al. | 166/120 X |
| 2,918,125 | 12/1959 | Sweetman | 166/55 X |
| 3,076,507 | 2/1963 | Sweetman | 166/55.2 X |
| 3,138,207 | 6/1964 | Peppers | 166/63 |
| 3,318,395 | 5/1967 | Messmer | 166/63 X |

*Primary Examiner*—Stephen J. Novosad
*Attorney, Agent, or Firm*—Fulbright & Jaworski

[57] ABSTRACT

An improved chemical cutting apparatus for cutting objects in well bores such as, for example, tubing in the bore of an oil or gas well. The apparatus is properly positioned relative to the object to be cut by means of a casing collar locator, and an igniter is fired which in turn activates a gas generator. Pressure from the gas generator axially displaces a slidable piston having suitable anchor means connected thereto. Movement of the piston causes the anchor means to move into contact with the object to be cut, thereby anchoring the apparatus relative to such object. Pressure generated in the gas generator is communicated through a passageway in the slidable piston and forces a chemical cutting agent into a chamber containing a reactant. The reaction of the chemical cutting agent and reactant increases the pressure and temperature within the chamber thereby displacing along the axis a second slidable piston. Movement of the second slidable piston exposes radial exhaust orifices thereby allowing the reacting elements in the chamber to escape with great velocity and to contact the object to be cut in incendiary fashion. The improvement according to the present invention resides in the provision of pressure relief means intermediate the gas generator and the chemical cutting agent for diverting a portion of the gas away from the chemical cutting agent so as to reduce the likelihood of release of the chemical cutting agent in the event the apparatus is mishandled or malfunctions.

8 Claims, 8 Drawing Figures

CHEMICAL CUTTING APPARATUS

CROSS-REFERENCE TO RELATED APPLICATIONS

This application is a continuation-in-part of Application Ser. No. 953,141, filed Oct. 20, 1978, and which will issue on Dec. 25, 1979, as U.S. Pat. No. 4,180,131, which in turn is a continuation-in-part of Ser. No. 830,511, filed Sept. 6, 1977 now U.S. Pat. No. 4,125,161.

BACKGROUND OF THE INVENTION

Reference is made to U.S. Pat. No. 4,125,161 granted on Nov. 14, 1978 for "Chemical Cutting Apparatus and Method for Use in Wells" (hereafter referred to as the '161 patent). The invention disclosed and claimed herein is directed to an improvement in apparatus subject of the '161 patent, that is, apparatus useful for cutting tubing, pipe and the like in the bore of an oil or gas well.

STATEMENT OF THE PRIOR ART

The most relevant prior art of which Applicant is aware is prior art disclosed and cited in Applicant's own '161 patent cited above and in U.S. Pat. No. 4,180,131 (the '131 patent). Inasmuch as the present application is directed to an improvement in apparatus disclosed in the '131 and '161 patents and not taught in any of the prior art references with respect thereto, discussions in the specification hereafter and the claims herein will serve to distinguish the references.

SUMMARY OF THE INVENTION

The present invention relates to a chemical cutting apparatus wherein the apparatus is a housing comprised of a series of interconnecting subassemblies (hereinafter referred to as "subs"). The diameters of the various subs are necessarily dependent upon the diameter of the object to be cut. Orienting the device to the vertical position, the most common orientation for use in a well hole, a casing collar locator, suitable for locating the chemical cutting apparatus relative to the desired point to be cut, is disposed on top. Attached to the bottom of the casing collar locator is a firing sub containing ignition means. Below the firing sub is a gas generator sub containing a standard granular gas generating material which is activated by an igniter in the firing sub. Preferably below the gas generator sub is a pressure relief sub constituting an important improvement over the devices of the '131 and '161 patents. Carried on the pressure relief sub is a valve mechanism for selective restriction of an aperture in the sub body which when opened permits venting of gas from the gas generator sub so as to reduce pressure of the gas and thereby minimize the possibility of actuation of the chemical cutting agent should the tool malfunction or be mishandled.

Below the pressure relief sub is an anchor sub with means for substantially centering and preventing movement of the device relative to the object to be cut during the period of cutting. Attached to the bottom of the anchor sub is a chemical cylinder containing a chemical cutting agent.

As disclosed in the '131 patent, a significant improvement of the device of the '161 patent is the provision of an integral catalyst sub and severing head formed of a metal such as a copper alloy for rapid conducting of heat to the exterior of the tool. The integral sub is secured below the chemical cylinder.

Also as disclosed in the '131 patent is the provision of a pressure sensing sub secured to and below the integral catalyst sub and severing head. The pressure sensing sub provides communication of pressure of fluid within the well (into which the apparatus is placed) to the piston of the integral catalyst sub and severing head. Back pressure is thus exerted against the piston which must be overcome by pressure of the gas, chemical cutting agent and catalyst before the piston is actuated for cutting purposes which results is a more effective cut.

It is, therefore, an object of the present invention to provide a device for generating pressures and temperatures capable of cleanly and efficiently cutting an object in an earth bore, such as, for example, metal tubing or pipe.

Another object of the present invention is to provide pressure relief means which when opened can vent substantial pressure of gas generated within the tool so as to minimize the risk of injury to persons operating the apparatus.

Other and further objects, features and advantages will be apparent in the following description of a preferred embodiment of the invention, given for the purpose of disclosure and taken in conjunction with the accompanying drawings.

DESCRIPTION OF THE PREFERRED EMBODIMENTS

Figure 1A:
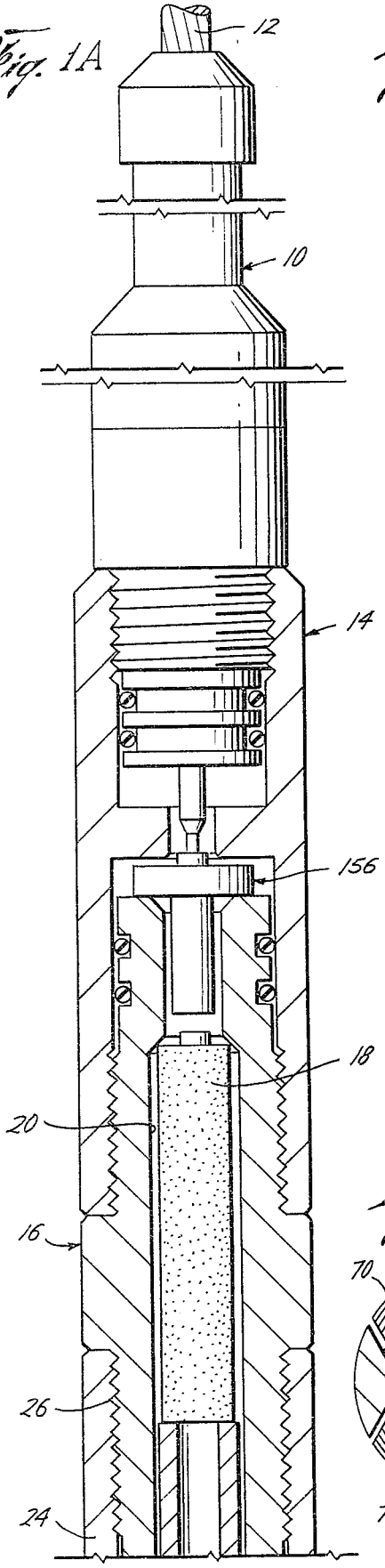
FIG. 1A is a foreshortened elevational view in section showing the casing collar locator, the firing sub housing a standard igniter and a gas generator sub containing a gas generator material therein.

Referring now to the drawings, and particularly FIG. 1A, the uppermost part of the tool of the present invention includes a "CCL" cable head assembly 10 and a wireline 12, "CCL" meaning a conventional casing collar locator. Connected to the CCL is the firing sub adapter 14 which in turn connects to the gas generator sub 16. The function of the gas generator sub 16 is to hold gas generator grain 18 within an axial bore 20. The gas generator grain may be any suitable slow-burning propellant that will develop gas pressure required for activating the tool in the manner hereafter described. The propellant generates gases when properly initiated with an initiator or an igniter in the igniter sub 14, the latter being any suitable conventional igniter means. While the gas generator grain 18 may be any suitable slow-burning propellant, the preferred propellant is a slow-burning ammonium nitrate base with a hydrocarbon binder, designated commercially as "RDS-254".

Figure 1B:
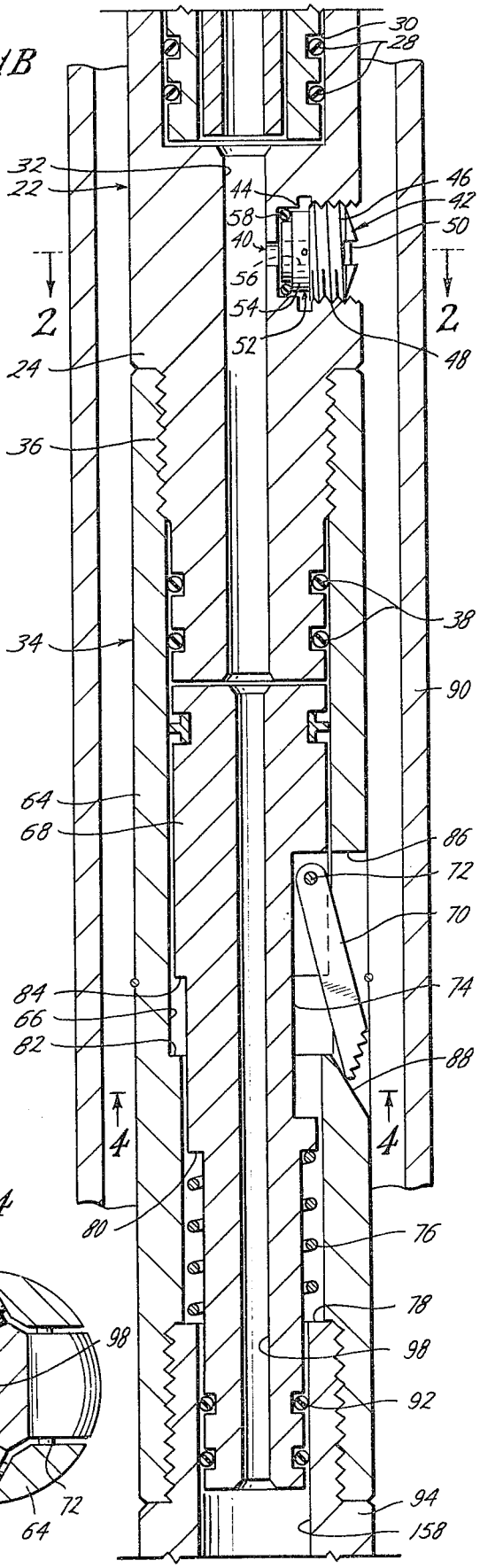
FIG. 1B is an elevational view in section showing the pressure relief sub with nut or valve means for releasing gas, and the anchor sub with a slidable piston therein having an axial bore running therethrough, at least one pivotally extendible wedge journalled to the slidable piston and a spring to bias the slidable piston upward as shown on the drawing.

As shown in FIG. 1B, attached to the gas generator sub 16 is the pressure relief sub 22 formed of a sub body 24 having internal threads 26 at its upper end engaging like external threads of the gas generator sub body. O-rings 28 are provided between the gas generator sub 16 and the internal surface 30 of the pressure relief sub body 24 for sealing purposes. The pressure relief sub body 24 has an axial internal bore 32 through which gas from the gas generator sub 16 may pass to the anchor sub 34. Threads 36 secure the lower end of the pressure relief sub 22 to the upper end of the anchor sub 34 and O-rings 38 provide sealing means between the outer surface of the pressure relief sub and the internal surface of the anchor sub as shown in the drawings.

Figure 2:
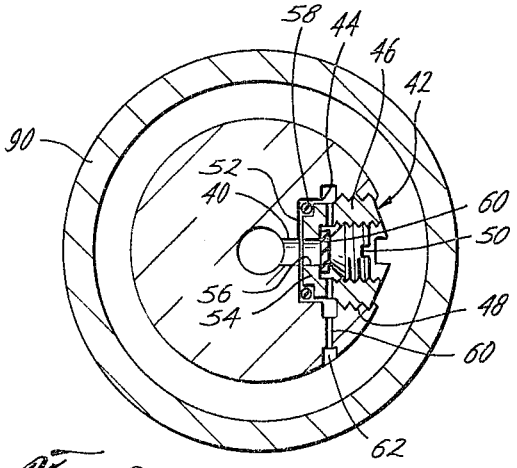
FIG. 2 is a partial cross-sectional view taken along the lines 2—2 of FIG. 1B illustrating the pressure relief sub and nut means forming a relief valve.

As shown in FIGS. 1B and 2, an aperture 40 opens and leads from the bore 32 of the pressure relief sub 22 and extends to the exterior surface of the body 24 of the pressure relief sub. A valve means 42 threadedly engages within an enlarged surface of the aperture 40 for selective restriction of the aperture in the sub body. The valve means comprises a nut 46 with threads 48 that engage the sub body 24; a stem 50 threadedly engageable with and axially of the nut 46; and a sealable seat means 52 within the enlarged portion 44 of the aperture 40 for closing the aperture 40 by engagement with the stem 50. The sealable seat means 52 includes a seat 54 having a hole 56 therethrough, and an O-ring seal 58 abuttable with a stepped surface on the seat 54 for sealably engaging the enlarged portion 44 of the aperture 40. An O-ring seal 60 provides a seal between the stem 50 and the nut 46. It is preferred that the threads 48 of the nut 46 be left-hand threads and that the threads by which the stem 50 engages the nut 46 be right-hand threads. In this manner, the nut 46 can be tightened within the safety sub body 24 and maintained in tight engagement when the stem 50 is loosened to permit exhaust of gas as will be explained hereafter.

As shown in FIG. 2, the exterior mouth 62 of a shunt portion 63 of aperture 40 is offset from the nut 46. The inner portion of the aperture 40, the widened portion 44 of the aperture, and the shunt portion 60 of the aperture leading to the mouth 62 form a continuous aperture or passageway from the bore 32 to the exterior of the pressure relief sub 22. The most restricted portion of the latter passageway should be of a large enough diameter to allow sufficient volume of gas to pass therethrough to prevent buildup of pressure of the gas downstream of the pressure relief sub 22 in such amounts as would cause release of the chemical cutting agent of the tool. On the other hand, the size of the passageway should not be so large as to sacrifice strength and structural integrity of the wall of the pressure relief sub body 24.

The combination of the nut 46, the stem 50, the seat 54 and the O-rings 58 and 60 is conventional. This particular combination may be obtained from Baker Oil Tools Company, Houston, Texas, it having been used by the latter company for post-pressurization release purposes rather than for pre-pressurization actuation as in the present embodiment.

Figure 4:
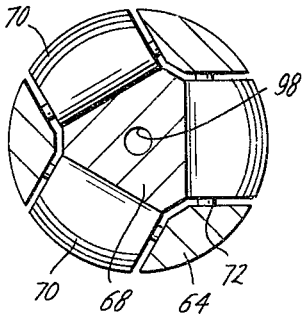
FIG. 4 is a partial cross-sectional view taken along lines 4—4 of FIG. 1B illustrating the piston-wedge combination wherein the wedges are shown in a collapsed position.
Figure 3A:
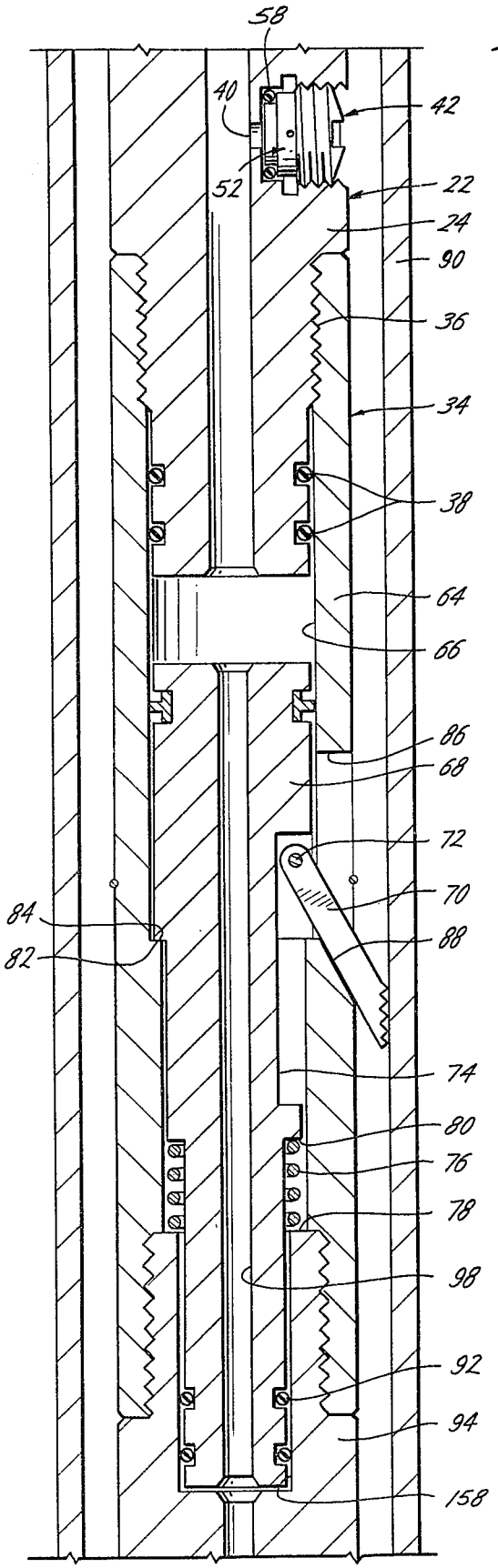
FIG. 3A is a partial elevational view in section showing one wedge of the anchor sub extended into engagement with the inner wall of the pipe to be cut.

The anchor sub 34 includes an anchor sub body 64 having an internal bore 66 axially therethrough. Positioned within the bore 66 is a piston 68 having three pivotally attached wedges 70. Each wedge 70 is journalled within an indentation 74 in the piston 68 by means of a pin 72. Furthermore, in the embodiment shown in the drawings, each wedge member 70 is positioned at 120° radial phasing (as shown in FIG. 4, which illustrates the wedges in a collapsed position as compared with FIG. 3A), and the piston 68 is biased upwardly by means of a spring 76 acting between the shoulder 78 of a lower member and a shoulder 80 on the piston 68. Downward movement of the piston 68 is limited by a shoulder 82 formed interiorly of the sub body 64 and a shoulder 84 formed exteriorly of the piston 68. The spring 76 is constructed of a suitable material so as to withstand the pressure exerted on it as well as the heat that is generated and the corrosive by-products from operation of the tool. When pressure is generated by the burning of the propellant grain in the gas generator sub 16, it forces the piston 68 to move downwardly in the anchor sub body 64 as shown in FIG. 3A, thereby forcing each of the wedges 70 outwardly through an elongate aperture 86 in the body 64 and on a tapered surface 88 to move out of the body and engage the pipe or tubing 90 so that the tool will be anchored positively within the tubing or pipe 90 to be cut and centralized at the same time. Since the wedges 70 are in the same plane, they will extend outwardly simultaneously, thereby assuring the proper positioning of the tool and the tubing 90 prior to the activation of the chemical cutting agent as will be explained.

Preferably the tapered surface in each of the apertures or windows 86 of the anchor sub body 64 is at about 30° angle relative to the axis of the tool. This angle may vary from about 28° to 33°, providing good support for the wedges 70 prior to firing.

The length of each wedge 70 is important inasmuch as the wedge must move outwardly sufficiently so that it will attach to and hold the interior diameter surface of the tubing 90 that is to be cut. For example, a tool having an outer diameter of 1 11/16 inches (i.e., the body 64) is set in tubing that is 1.995 inches interior diameter to cut the tubing 90. Thus each of the wedges 70 must extend to a point comprising an outer diameter slightly greater than two inches. In this particular example, the wedges could extend to a maximum of 2.1 inches to allow for drift diameter of the tubing 90, and the outer end of each of the wedges 70 is located approximately 0.0015 inch inwardly from the outer diameter of the anchor sub body 64 in the pre-firing position as shown in FIG. 1B. The wedges 70 thus in effect expand the effective diameter of the body 64 in three places. This can be accomplished also with two wedges, with four wedges, or five or with as many as the anchor sub body 64 of the tool can accommodate, each wedge being wide enough to have holding surface area being against the tubing to be cut without weakening the body 64. Also, it is not necessary that all of the wedges be in the same axial plane. In a larger diameter tool, three wedges may be radially spaced at 120° at one vertical level and three more at another vertical level, for example. Finally, at the lower extremity of the piston 68, there are grooves to accommodate seals 92 so as to sealably engage between the lower end of the piston 68 and the internal surface of the next sub, in this case a sub 94 that secures the chemical cylinder 96 to the anchor sub 34.

There is shown in FIG. 1B an axial bore 98 through the piston 68. This bore allows gas and gas pressure that is generated in the gas generator 16 to be transmitted into the lower section of the tool for coaction with the chemical cutting agent 100 in the chemical cylinder 96 (FIG. 1C), the chemical cutting agent being expelled from the orifices of the severing head to effect the cut in the tube 90. However, the bore 98 of the piston 68 is of a smaller diameter than the bore 32 of the gas generator sub 16 to create a restriction to force the piston 68 downwardly upon firing of the tool.

Figure 1C:
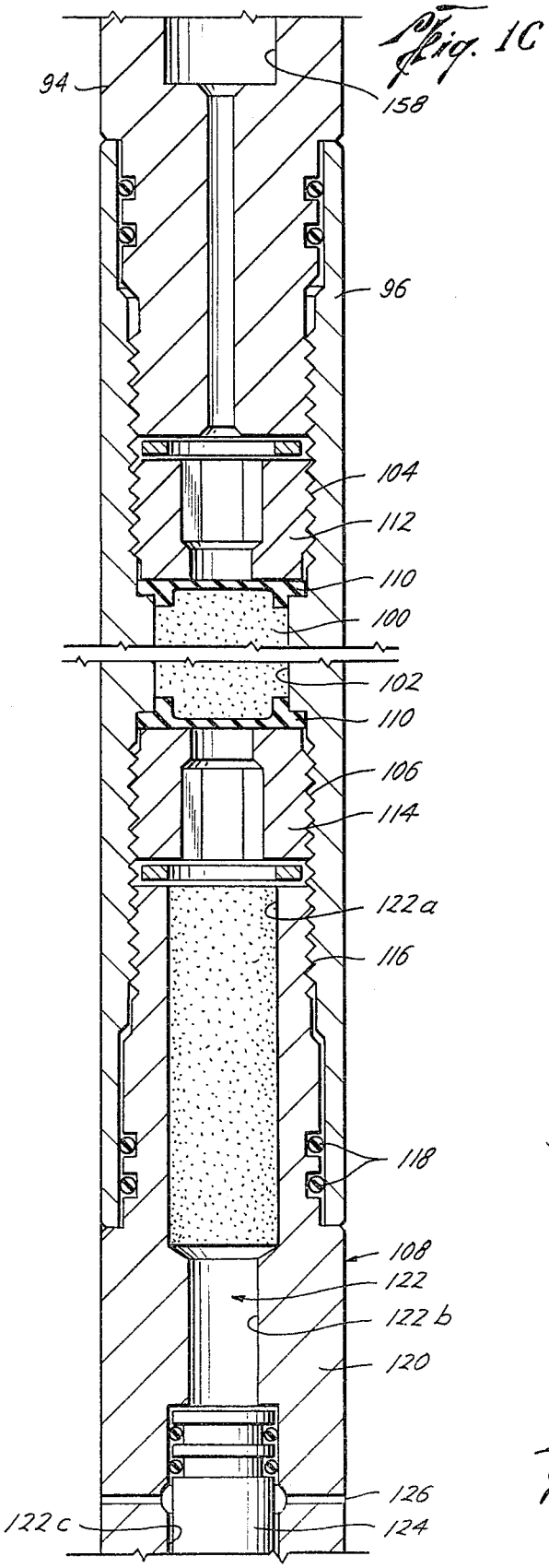
FIG. 1C is an elevational view in section and foreshortened for clarity showing the chemical cylinder housing, a chemical cutting agent or fluid disposed between two rupture discs and an integral reactant/severing sub.

Referring now to FIG. 1C, attached to the anchor sub 34 is the chemical cylinder 96 which contains a chemical cutting agent 100. Any of the cutting fluids or agents that are disclosed in U.S. Pat. No. 2,918,125 may be used, brominetrifluoride being preferred. The chemical cylinder 96 is provided with a bore 102 and has a certain length and bore diameter so as to contain a volume of chemical in proportion to the size of tubing that is being cut. Because the cutting process involves an oxidation-reduction reaction, the amount of chemical needed is in proportion to the amount of metal in the tubing that is being cut. A larger tubing would require more chemical than a smaller tubing and therefore the size of tubing being cut dictates the size of the cylinder 96.

The chemical cylinder 96 is appropriately threaded as by means of threads 104 so as to engage the connecting sub 94 and by means of threads 106 so as to engage the integral catalyst sub and severing head 108.

A safety feature embodied in the tool is the use of rupture discs 110 in the upper and lower ends of the bore of the cylinder 96. The upper rupture disc is positioned below a jam insert 112 while the lower rupture disc is above a jam insert 114. Thus the rupture discs 110 seal the chemical 100 within the bore 102 of the cylinder 96. The rupture discs serve to rupture at a predetermined pressure which is important in the functioning of the tool from a safety standpoint. A preset rupture strength, preferably 9000 pounds per square inch (psi) is selected to avoid premature firing of the tool in the well should any fluid from the well leak into the tool. The rupture discs 110 maintain back pressure on the orifices in the severing head 108 to develop pressure should cutting take place in a shallow well having less than 9000 pounds pressure hydrostatic head. While the preferred burst pressure is about 9000 psi, the tool could function at lower pressures, the 9000 psi rupturing pressure being selected to eliminate premature firing of the tool in most applications. Both ends of the cylinder 96 are identical as are the two jam nuts 112 and 114 and the two rupture discs 110. The discs may rupture from one end or the other end internally or externally at the same pressure.

Figure 1D:
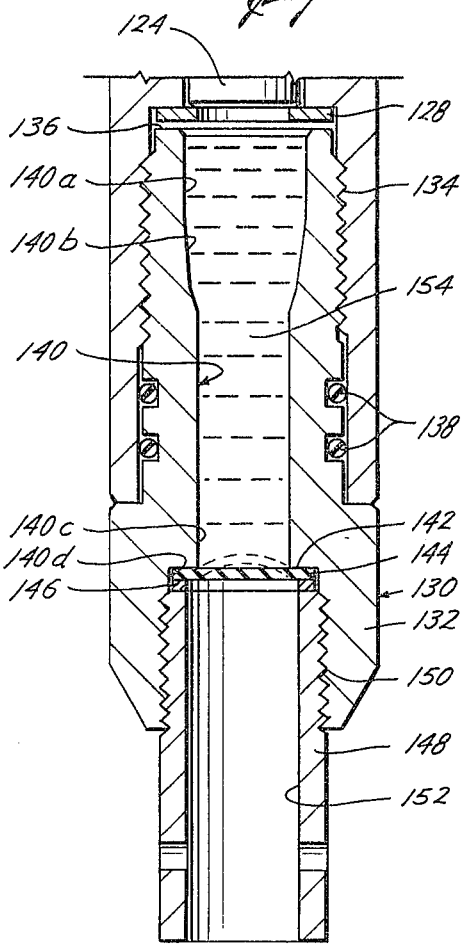
FIG. 1D is an elevational view in section showing the pressure sensing sub and bull plug assembly.

Referring now to FIGS. 1C and 1D, the threaded member 108 is an integral catalyst sub and cutting head assembly, integral in the sense that the catalyst sub and severing heads were separate subs in the apparatus subject of the '161 patent. The integral sub 108 is secured by means of threads 116 to the chemical cylinder 96. As in other subs of the apparatus, suitable O-rings 118 may be disposed between the outer surface (of reduced diameter) of the integral sub 108 and the interior surface of the chemical cylinder 96.

The integral sub 108 has a body member 120 forming a segment of the generally elongate cylindrical structure of the overall apparatus and includes an axial bore 122 therethrough. The bore 122 has a portion **122*a* at the first or upper end thereof of a diameter sufficient to form a chamber (referred to herein also by the reference character 122*a*). Catalyst material is disposed within the chamber 122*a*, and the chamber 122*a* communicates directly with a second or lower bore portion 122*b* of reduced diameter, also referred to herein as a restriction 122*b*. Pressure of the gas, chemical cutting agent and catalyst is increased as these materials pass through the restrictive bore 122*b*** upon operation of the tool.

Figure 3B:
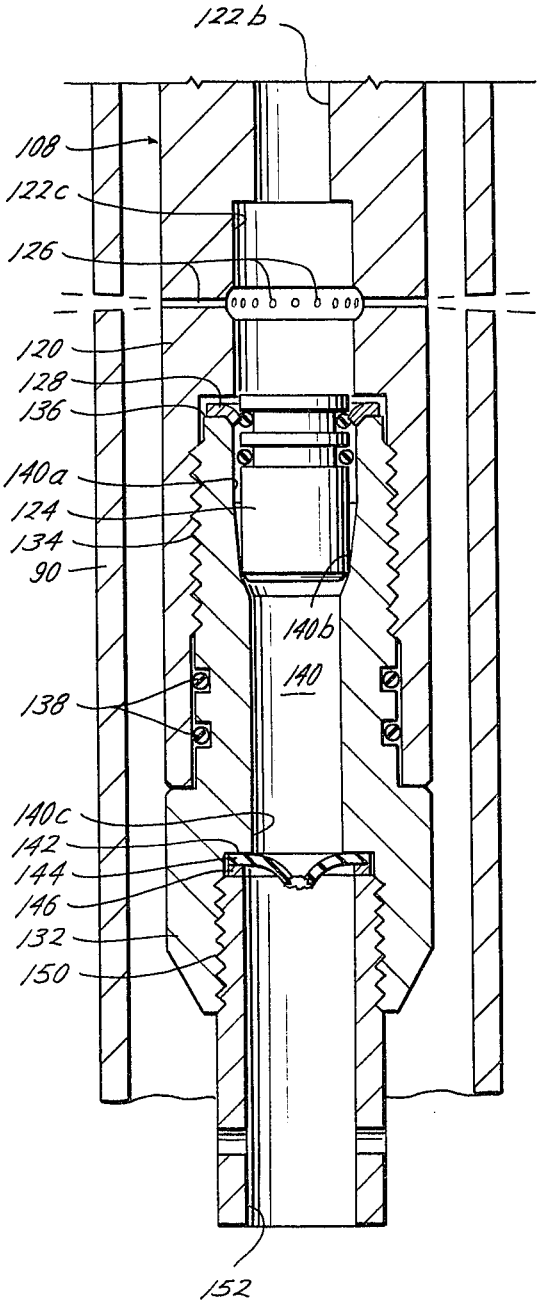
FIG. 3B is a partial elevation view in section illustrating the piston of the severing head in its lower postion for release of chemical for cutting of the outer pipe.

The bore 122 of the integral sub 108 again widens out in the portion **122*c* so as to receive a piston member 124 that is slidable within the bore 122*c*. A plurality of radial apertures 126 provide communication between the bore 122*c* of the body member 120 and the exterior of the body member for purposes of expelling the gas, chemical cutting agent and catalyst in incendiary cutting fashion. The piston 124 is slidable within the bore 122*c* between a first position as shown in FIGS. 1C and 1D such that the piston sealably closes the radial apertures 126. When moved to a second and lower position upon actuation of the tool as shown in FIG. 3B, the piston 124 is spaced from and thus opens the apertures 126 to the bore 122*c*. The piston 124 is maintained in its first or sealing position by means of a shear washer 128 such as a copper washing or other suitable means serving as a shear mechanism, and O-ring seals 125 seal between the exterior of the piston 124 and the bore 122*c* above the apertures 126**.

While the material 123 previously referenced as the "catalyst" within the chamber **122*a* is not necessarily a catalyst per se, it is material that will react with the chemical cutting agent 100 to produce the necessary temperature to start the fast oxidation process between the chemical 100 and the tubing or other object 90 to be cut. It is not understood whether the interaction of the chemical cutting agent 100 and the matter 123 in the chamber 122*a* is catalytic or reactive; the result, however, is that ignition does occur which greatly increases the velocity and effectiveness of the cutting action of the ignited chemical cutting agent 100. The material 123 in the chamber 122*a* of the integral sub 108** can be of any of the preignition materials disclosed in U.S. Pat. No. 2,918,125 such as glass wool, steel wool and the like.

Advantageously, the emission product, i.e., gas of the gas generator 16, reacts with the chemical cutting agent 100 contained in the chemical cylinder 96 to produce additional energy, temperature and pressure that are useful in the completion of the reaction between the chemical 100 and the tubing to be cut. The gas products include hydrocarbon materials that react violently with the chemical 100, thereby increasing the temperature of the reaction of the chemical 100 with the pipe or tubing 90 to be cut.

The evolution of gas in the gas generator 16 exerts pressure on the upper rupture disc 110, rupturing the disc 110 and forcing the chemical 100 downward and then rupturing the bottom rupture disc 110 such that the chemical 100 passes over the catalyst or reactant material 123 in the chamber **122*a*, igniting that material. The hot molten particles or globules that are contained in the chamber 122*a* after ignition are forced out through the plurality of radial orifices 126 in the integral sub 108 and attack the interior diameter of the tubing 90 so that hot particles heat the surface of the tubing, preparing it for further reaction between the chemical 100 and the surface of the tubing 90**.

The material of construction of the integral sub 108 preferably is a copper alloy such as ASTM B133 Hard Drawn Copper so that heat is transmitted readily and the integral sub itself does not enter into a reaction or burn with the chemical 100. The size and number and hence the total area of the orifices 126 should be in direct proportion to the area of the bore 98 in the anchor sub piston 68. Construction of the device may be varied from that shown in the drawings and, instead of the provision of a plurality of radial orifices 126, a circumferential separation, slot or gap in place of the orifices and of a predetermined surface area, i.e., equal to or preferably smaller than that of the cross-sectional area of the bore 98 in the anchor sub piston 68 would achieve the desired end result of severing the pipe 90 or perforating it, depending on the function desired.

By constructing the integral catalyst sub and severing head 108 of a high heat conducting metal such as hard drawn copper, the walls of the body 120 are able to dissipate heat to the exterior of the tool during firing thereof. This in turn significantly reduces the opportunity for structural breakdown of the body walls which would be more likely to occur if the integral sub 108 were constructed of steel. It has been found that, when the body 120 is constructed of steel, the products of the mixture and/or reaction of the gas, chemical cutting agent and catalyst attack the steel and cause it to burn. As a result, pieces of the steel sluff off, pass downwardly through the tool and cause at least partial blockage of the exhaust orifices 126. This creates an imbalance in the cutting action and hence an incomplete cut of the object such as tubing 90 to be cut. Therefore, constructing the integral sub 108 of hard drawn copper greatly increases the effectiveness of the cutting action and materially extends the life of the tool.

Combining the catalyst 123 in the chamber 122*a* and the severing head exhaust ports 126 in the single integral sub 108 is advantageous not only for the reasons discussed but also because there are fewer parts to be assembled. More importantly, however, it has been discovered that the provision of a restriction in the bore 122 after the catalyst 123 and ahead of the piston 124, i.e., the narrowed bore portion 122*b*, results in higher exhaust pressure for the cutting agent. That is, by providing the lower portion 122*b* with a measured diameter smaller than the diameter of the piston 124 and smaller than diameters of the bores between the restriction 122*b* and the chemical cutting agent 110, more pressure is exerted by the gas, chemical cutting agent and catalyst against the piston 124 during firing so as to actuate the piston more readily and exhaust more chemical expediently against the object to be cut.

The internal diameter of the bore section 122*b* preferably is about 25% less than the internal diameter of the catalyst chamber 122*a*. This reduction of diameter results in pressure of the gas, chemical cutting agent and catalyst exerted against the piston 124 upon firing of the tool being increased substantially over pressure that would be experienced if such diameters were equal. It is desirable to maintain a pressure differential between the upstream and downstream sides of the piston 124, that is, between the chamber 122*b* and the exterior of the tool in well bore ambient pressure conditions. That is, upon firing, it is desirable to have a pressure of from 3000 to 5000 pounds per square inch (psi) ahead of the piston 124 and in excess of the ambient pressure in the well to effectively exhaust the gas, chemical cutting agent and catalyst through the exhaust orifices 126 for effective cutting of the object 90. Providing the restriction in the form of the reduced diameter bore 122*b* increases pressure for this purpose and reduces the amount of gas generating grain material 18 that otherwise would be required to provide the pressure differential. Conversely, if increased cutting power is required, the restriction 122*b* provides a greater pressure differential to achieve the cutting action without having to increase the size of the overall tool, particularly the gas generator sub 16. Thus, the restriction 122*b* accomplishes several functions and greatly enhances utility and versatility of the cutting tool.

Advantageously, the pressure sensing sub 130 coacts with the integral sub 108 to provide the pressure differential discussed above, while at the same time protecting the interior of the integral sub from debris and the like that might otherwise cause a malfunction. The pressure sensing sub 130 includes a sub body 132 having external threads 134 mating with similar internal threads within the lower end of the integral sub 108. The upper end 136 of the body 132 is a jam surface that presses against the shear washer 128 to retain the washer in place. Suitable O-ring seals 138 are provided between the pressure sensing sub body 132 and the integral sub 108 for sealing purposes.

The pressure sensing sub 130 has an axial bore 140 therethrough communicating with the axial bore 122 of the integral sub 108. The upper portion 140*a* of the bore 140 tapers as at 140*b* to a smaller diameter so as to wedgingly receive the piston 124 upon actuation of the tool. The bore portion 140*c* extends to a point whereby the bore widens as at 140*d* to form a seat 142. A resilient diaphragm 144 rests on the seat 142 and is retained in that position by means of a centralizing washer 146 and a bull plug threaded jam portion 148 connected by means of threads 150 to like threads within the pressure sensing sub body 132.

The bull plug 148 is provided with an axial bore 152 so as to permit fluid communication between the exterior of the bull plug 148 and the interior of the pressure sensing sub 130 and the diaphragm 144. That is, the bore 152 is open to well conditions such that well fluid engages the diaphragm 144 and exerts pressure against it. Advantageously, the bull plug 148 may also serve as a mechanical centralizing system to insure centralizing of the integral catalyst sub and severing head 108 within the object to be cut. Appropriate rubber or other fingers for this purpose are well known in the art.

With respect once again to the pressure sensing sub 130, any suitable oil such as, for example, motor oil may be used to fill the bore 140 between the piston 124 and the diphragm 144. Consequently, pressure of the well fluid exerted below the diaphragm 144 is transmitted via the oil to and against the piston 124 such that the hydrostatic head of the well thereby exerts pressure on the piston 124 retaining the piston in the position shown until sufficient pressure is generated upon actuation equal to or greater than the hydrostatic head in the well. Should pressure in the well be, for example, 20,000 psi, the piston 124 will not move from the position shown in FIGS. 1C and 1D into the tapered portion 140*b* of the bore 140 of the pressure sensing sub 130 until the gas generator 16 has developed sufficient pressure in excess of 20,000 psi together with pressure of the chemical 100 and the catalyst 123 so that the piston 124 moves downwardly to shear the washer 128. Upon the shearing action of the washer 128, the piston 124 engages the tapered portion 140*b*, allowing the gas, chemical cutting agent and catalyst out of the orifices 126 at a greater pressure than the back pressure of the well fluid surrounding the orifices. Because of the high temperatures involved, it is preferred that the piston 124 and the shear washer 128 be constructed of copper alloy similar to that used for the integral sub body 120 for heat dissipation purposes.

The diaphragm 144 may be formed from, for example, nylon reinforced neoprene rubber. It has been found that a thickness of about 0.062 inch is satisfactory although thicknesses in the range of from about 0.050 to about 0.070 are quite acceptable. A thinner diaphragm is generally impractical because it would be more susceptible of being cut during assembly of the tool. Thicker diaphragms are generally unnecessary because it is not subjected to appreciable strains during its pre-ignition functioning.

Assembly of the tool of the present invention begins by degreasing and cleaning all of the component parts by use of a solvent that will leave no residue on the parts. After the parts have been washed with the degreasing fluid, they are blown dry with air. All sealing grooves receive the proper O-ring and "T" seals and backup rings when required. The gas generator sub 16 receives the gas generator grain in the bore 20. The pressure relief sub 22 is then threadably attached to the gas generator sub, and the pressure relief valve 42 is opened by turning the stem 50 counterclockwise so as to open the aperture 40, thereby opening the bore 32 to the atmosphere. Then the anchor sub piston is assembled by attachment of the wedges 70, the spring 76, O-rings and T seals to the piston 68 which is then inserted in the anchor sub body 64. The wedges 70 are positioned on the taper 88 in a pre-firing position. Then the anchor sub assembly 34 is connected to the pressure relief sub 22. The gas generator sub 16, when actuated, applies sufficient force on the piston 68 to seat the piston in the proper position as shown in FIG. 3A.

While it is desirable that the pressure relief sub 22 be placed between the gas generator sub 16 and the anchor sub 34 so that the pressure relief sub is closest to the gaseous source, it will be understood that the pressure relief sub may be relocated to a position between the anchor sub 34 and the chemical cylinder 96. In either event, the object of the pressure relief sub, when the valve 42 is opened, is to vent a substantial portion of gas generated from the gas generator sub 16 to the atmosphere through the aperture 40 in the event of mishandling, accident or unexpected firing of the ignition means 14 during assembly or other handling. Thus, sufficient pressure is relieved through the pressure relief sub to reduce the possibility that the rupture discs 110 might rupture unexpectedly and cause actuation of the entire tool and possible consequent personal injury and/or property damage.

Continuing with respect to assembly of the tool in the manner shown in the drawings, the piston 124 is placed within the bore portion 122*c* of the integral sub 108, the shear washer 128 inserted, and the body 132 of the pressure sensing sub 130 is threadably attached to the integral sub. Motor oil 154 is added to the bore 140 of the pressure sensing sub 130, and the diaphragm 144, the washer 146 and the bull plug 148 are secured in place as shown in the drawing. The chemical cylinder 96 with the chemical 100 secured therewith as shown in the drawing is made up to the anchor sub 34 via the sub 94, the catalyst material 123 is placed within the chamber 122*a*, and the integral sub 108 is secured to the chemical cylinder 96.

Preferably, prior to the attachment of the chemical cylinder 96 to the rest of the tool, the cylinder is inspected for leakage that may have developed in transport. Ideally, the cylinder will be shipped to the field with the chemical 100 already in it and properly sealed with the jam inserts 112 and 114 and the rupture discs 110. Then the chemical cylinder 96 is attached to the anchor sub, followed by the integral sub 108 to which the pressure sensing sub 130 has already been attached as explained above. The tool is now completely made up. At this point the service unit operator insures that an electrical circuit connects through the casing collar locator 10, making certain that there are proper connections and an adequate supply of current coming through electrical lines.

Only at this point, that is, immediately before inserting the tool in the well, is the valve means 42 of the pressure relief sub 22 closed. Accordingly, the stem 50 is turned clockwise (because of the right-hand thread) thereby closing off the aperture 40 so that all pressure developed by the gas generator sub 16 is exerted against the downstream elements within the apparatus.

In operation, once the point of the tubing or other object 90 to be cut has been located, the operator lowers the tool to that point, sends a current through the wireline 12 that activates the igniter means 156 which in turn initiates the gas generator grain 18 in the bore 20 of the sub 16 to generate pressure that is needed to force the piston 68 in the anchor sub 34 to set the wedges 70 in the tubing and anchor the tool positively in one place. The pressure wave continues through the bore 98 of the piston 68, the bore portion 158 of the anchor sub, and thence into the bore 102 of the chemical cylinder 96 to rupture the disc 110 in the chemical cylinder, forcing the chemical 100 to pass over the catalyst or reactant 123 in the chamber 122*a* of the integral sub 108. The pressure wave then acts against the piston 124 to force it downwardly into the position shown in FIG. 3A after shearing the shear washer 128, thereby opening the orifice 126. Thus, the gas, chemical cutting agent, and catalyst or reactant pass outwardly through the orifices 126 where the incendiary cutting action takes place, cutting the pipe or tubing 90.

Upon retrieval of the tool from the well, and if the tool failed to operate for any reason such as the firing sub 14 not functioning, pressure relief sub is vented first by opening the valve means 42 by unscrewing the shem 50. Then, if the tool should fire accidentally during handling, substantial pressure would be vented through the aperture 40 and out the opening 62. Thus, the pressure relief sub functions to greatly reduce the risk of injury to personnel.

In constructing and operating the tool of the present invention, there should be a correlation of the pressure at which the discs 110 rupture and the size of the smallest restriction in the passageway formed between the aperture 40 and the opening 62 in the pressure relief sub 22. This correlation permits sufficient pressure of the gas from the gas generator 16 to be exhausted out of the opening 62 as a safety feature. For example, if the burst pressure of the discs 110 is 9000 psi, the diameter of the aperture 40 adjacent the bore 32 may be about 0.156 inch, the diameter of the aperture 56 may be about 0.125 inch, and the diameter of the shunt bore 60 may be about 0.125 inch. These sizes will provide for substantial release of gas and pressure before the discs 110 rupture for an apparatus having dimensions mentioned elsewhere herein.

As has been explained, the preferred grain for use in the gas generator sub 16 of the present invention is available commercially under the designation "RDS 127" or "RDS 254". This grain is basically an ammonium nitrate base with a hydrocarbon binder. Thus its initiation and byproducts provide hydrocarbon materials that react violently with the preferred chemical 100 which comprises bromine trifluoride. Consequently, high pressures are developed inside the tool of the present invention, and the pressures are maintained albeit instantaneously until the reaction between the chemical 100, the catalyst or reactant 123, and the object 90 to be cut takes place.

The present invention, therefore, is well adapted to carry out the objects and attain the ends and advantages mentioned as well as others inherent therein. While a presently preferred embodiment of the invention has been given for the purpose of disclosure, numerous changes in the detail of construction and the combination, shape, size and arrangement of parts may be resorted to without departing from the spirit and scope of the invention as hereinafter claimed.

What is claimed is:

1. In an apparatus for cutting an object within an earth bore, comprising a generally elongate, cylindrical structure that includes, (a) means for suspending the apparatus within the bore, (b) firing means for producing ignition temperatures, (c) means for generating gas under pressure by ignition from the firing means (b), (d) anchor means activated by pressure produced by the gas generating means (c) for maintaining the apparatus substantially stationary in axial relation to the earth bore, during the cutting operation, (e) chemical means releasably contained within the apparatus for incendiary cutting of the object within the earth bore upon release of said chemical means, (f) discharge means for directing the chemical means (e) toward the object to be cut within the earth bore, the improvement comprising, (g) pressure relief means intermediate the gas generating means (c) and the chemical means (e) for diverting a portion of said gas exteriorly of the cylindrical structure ahead of and away from the chemical means (e) so as to reduce the likelihood of release of the chemical means (e) in the event said apparatus is mishandled or malfunctions.

2. The apparatus of claim 1 wherein the pressure relief means (g) is positioned between the gas generating means (c) and the anchor means (d).

3. The apparatus of claim 1 wherein the pressure relief means (g) comprises, (i) a sub body threadedly engaging the gas generating means (c) at one end thereof and the remainder of said apparatus at the other end, said sub body having an axial bore therethrough and at least one aperture providing communication between the bore and the exterior of the sub, and (ii) valve means threadedly engaging the sub body (i) for selective restriction of the aperture in thesub body.

4. The apparatus of claim 3 wherein the valve means (ii) comprises, a nut threadedly engaging the sub body (i), a stem threadedly engageable with and axially of the nut and positioned so as to engage the aperture of the sub body (i), and sealable seat means within the aperture of the sub body (i) for closing said aperture by engagement with the stem.

5. In an apparatus for cutting an object within an earth bore, comprising a generally elongate, cylindrical structure that includes, (a) means for suspending the apparatus within the bore, (b) firing means for producing ignition temperatures, (c) means for generating gas under pressure by ignition from the firing means (b), (d) anchor means activated by pressure produced by the gas generating means (c) for maintaining the apparatus substantially stationary in axial relation to the earth bore, during the cutting operation, (e) chemical means releasably contained within the apparatus for incendiary cutting of the object within the earth bore upon release of said chemical means, (f) discharge means for directing the chemical means (e) toward the object to be cut within the earth bore, the improvement comprising, (g) pressure relief means positioned between the gas generating means (c) and the anchor means (d) for diverting a portion of said gas exteriorly of the cylindrical structure ahead of an away from the chemical means (e) so as to reduce the likelihood of release of the chemical means (e) in the event said apparatus is mishandled or malfunctions, said pressure relief means more particularly including, (i) a sub body threadedly engaging the gas generating means (c) at one end thereof and the remainder of said apparatus at the other end, said sub body having an axial bore therethrough and at least one aperture providing communication between the bore and the exterior of the sub, and (ii) valve means threadedly engaging the sub body (i) for selective restriction of the aperture in the sub body, including, a nut threadedly engaging the sub body (i), a stem threadedly engageable with and axially of the nut and positioned so as to engage the aperture of the sub body (i), and sealable seat means within the aperture of the sub body (i) for closing said aperture by engagement with the stem.

6. An apparatus for cutting an object within an earth bore, comprising a generally elongate, cylindrical structure including, (a) means for suspending the apparatus within the bore, (b) firing means for producing ignition temperatures, (c) means for generating gas by ignition from the firing means (b), (d) anchor means activated by the gas generating means (c) for maintaining the apparatus substantially stationary in axial relation to the earth bore, during the cutting operation, (e) chemical means releasably contained within the apparatus for incendiary cutting of the object within the earth bore upon release of said chemical means, (f) an integral catalyst and severing sub attached to the cylindrical structure adjacent the chemical means (e) so as to receive and direct said chemical means toward the object to be cut within the earth bore, and more particularly comprising, (i) a body member forming a segment of the generally elongate, cylindrical structure of the apparatus and having an axial bore therethrough with a first end adjacent the chemical means (e) and a second end opposed therefrom, (ii) a portion of the bore at the first end having a diameter forming a chamber, (iii) catalyst material disposed the chamber (ii), (iv) said body member (i) having at least one radial aperture between its first and second ends providing communication between the bore of said body member and the exterior of the body member, (v) a piston coaxail with and axially slideable within the bore of the body member (i) between a first position such that the piston sealably closes the radial aperture (iv) and a second position spaced from and opening the aperture, (vi) means for releasably retaining the piston (v) in its first position, and (vii) a restriction in the bore of the body member (i) between the chamber (ii) and the aperture (iv) formed by reducing the diameter of said bore whereby pressure of the gas, chemical means and catalyst is increased as they pass through said restriction, (g) a well pressure sensing sub coacting with and secured to the discharge means (f) and including, (i) a body engageable with the discharge means (f) and having an axial bore therethrough communicating with the bore of the body member (f)(i) of the discharge means (f), (ii) resilient diaphragm means within the bore of the body (g)(i) for pressure communication across said diaphragm means, and (iii) hydraulic fluid within the bore of the body (g)(i) between the resilient diaphragm means (ii) and the discharge means (f) and within the bore of the body member (f)(i) whereby well bore pressure may be transmitted via the diaphragm (ii) and said hydraulic fluid to the piston (f)(iii), and (h) pressure relief means intermediate the gas generating means (c) and the chemical means (e) for diverting a portion of said gas exteriorly of the cylindrical structure ahead of and away from the chemical means (e) so as to reduce the likelihood of release of the chemical means (e) in the event said apparatus is mishandled or malfunctions.

7. The apparatus of claim 6 wherein the pressure relief means (h) is positioned between the gas generating means (c) and the anchor means (d).

8. The apparatus of claim 6 wherein the pressure relief means (g) comprises, (i) a sub body threadedly engaging the gas generating means (c) at one end thereof and the remainder of said apparatus at the other end, said sub body having an axial bore therethrough and at least one aperture providing communication between the bore and the exterior of the sub, and (ii) valve means threadedly engaging the sub body (i) for selective restriction of the aperture in the sub body.

* * * * *